US008529102B2

(12) United States Patent
Pickard et al.

(10) Patent No.: US 8,529,102 B2
(45) Date of Patent: Sep. 10, 2013

(54) REFLECTOR SYSTEM FOR LIGHTING DEVICE

(75) Inventors: Paul Kenneth Pickard, Morrisville, NC (US); Ryan Kelley, Denver, CO (US)

(73) Assignee: Cree, Inc., Durham, NC (US)

( * ) Notice: Subject to any disclaimer, the term of this patent is extended or adjusted under 35 U.S.C. 154(b) by 394 days.

(21) Appl. No.: 12/418,796

(22) Filed: Apr. 6, 2009

(65) Prior Publication Data

US 2010/0254128 A1 Oct. 7, 2010

(51) Int. Cl.
*F21V 7/00* (2006.01)

(52) U.S. Cl.
USPC ..... 362/298; 362/231; 362/346; 362/311.02; 362/348

(58) Field of Classification Search
USPC ..... 362/231, 298, 296.01, 296.02, 311.02, 362/346, 348
See application file for complete search history.

(56) References Cited

U.S. PATENT DOCUMENTS

| | | | | |
|---|---|---|---|---|
| 1,393,573 | A | 10/1921 | Ritter | 362/509 |
| 1,880,399 | A | 10/1932 | Benjamin | |
| 2,214,600 | A | 9/1940 | Winkler | 362/279 |
| 2,981,827 | A | 4/1961 | Orsatti et al. | 362/84 |
| 3,395,272 | A | 7/1968 | Nicholl | 362/305 |
| 4,420,800 | A | 12/1983 | Van Horn | 362/297 |
| 4,946,547 | A | 8/1990 | Palmour et al. | 156/643 |
| 5,200,022 | A | 4/1993 | Kong et al. | 156/612 |
| 6,414,801 | B1 | 7/2002 | Roller | |
| 6,454,439 | B1 | 9/2002 | Camarota | 362/293 |
| 6,558,032 | B2 | 5/2003 | Kondo et al. | 362/516 |
| 6,585,397 | B1 * | 7/2003 | Ebiko | 362/297 |
| 6,657,236 | B1 | 12/2003 | Thibeault et al. | 257/98 |
| 6,720,583 | B2 | 4/2004 | Nunoue et al. | 257/98 |
| 6,758,582 | B1 * | 7/2004 | Hsiao et al. | 362/302 |

(Continued)

FOREIGN PATENT DOCUMENTS

| | | | |
|---|---|---|---|
| WO | WO 2005/066539 | A1 | 7/2005 |
| WO | WO 2005/078338 | A1 | 8/2005 |

(Continued)

OTHER PUBLICATIONS

C.H. Lin et al., "Enhancement of InGaN-GaN Indium-Tin-Oxide Flip-Chip Light-Emitting Diodes with TiO2-SiO2 Multilayer Stack Omnidirectional Reflector," IEEE Photonics Technology Letters, vol. 18, No. 19, Oct. 1, 2006, pp. 2050-2052.

(Continued)

*Primary Examiner* — Peggy A. Neils
(74) *Attorney, Agent, or Firm* — Koppel, Patrick, Heybl & Philpott

(57) ABSTRACT

A reflector system for a lighting device. The system uses two reflective surfaces to redirect the light before it is emitted. The light source/sources are disposed at the base of a secondary reflector. The first reflective surface is provided by a primary reflector which is arranged proximate to the source/sources. The primary reflector initially redirects, and in some cases diffuses, light from the sources such that the different wavelengths of light are mixed as they are redirected toward the secondary reflector. The secondary reflector functions primarily to shape the light into a desired output beam. The primary and secondary reflectors may be specular or diffuse and may comprise faceted surfaces. The reflector arrangement allows the source to be placed at the base of the secondary reflector where it may be thermally coupled to a housing or another structure to provide an outlet for heat generated by the sources.

62 Claims, 6 Drawing Sheets

(56) References Cited

U.S. PATENT DOCUMENTS

| | | | | |
|---|---|---|---|---|
| 6,793,373 | B2 | 9/2004 | Matsuba et al. | 362/260 |
| 6,812,502 | B1 | 11/2004 | Chien et al. | |
| 6,817,737 | B2 | 11/2004 | Romano | 362/293 |
| 6,851,834 | B2 * | 2/2005 | Leysath | 362/303 |
| 6,986,594 | B2 | 1/2006 | Wirth et al. | 362/328 |
| 7,055,991 | B2 * | 6/2006 | Lin | 362/311.02 |
| 7,121,690 | B1 * | 10/2006 | Ramer et al. | 362/297 |
| 7,213,940 | B1 | 5/2007 | Van de Ven et al. | 362/231 |
| 7,275,841 | B2 * | 10/2007 | Kelly | 362/345 |
| 7,573,074 | B2 | 8/2009 | Shum et al. | 257/99 |
| 7,607,808 | B2 * | 10/2009 | Birman et al. | 362/489 |
| 7,622,746 | B1 | 11/2009 | Lester et al. | 257/98 |
| 7,722,220 | B2 | 5/2010 | Van De Ven | 362/294 |
| 7,784,977 | B2 | 8/2010 | Moolman et al. | 362/298 |
| 7,795,623 | B2 | 9/2010 | Emerson et al. | 257/79 |
| 7,821,023 | B2 | 10/2010 | Yuan et al. | 257/98 |
| 7,915,629 | B2 | 3/2011 | Ibbetson et al. | 257/98 |
| 7,922,366 | B2 * | 4/2011 | Li | 362/304 |
| 2003/0025212 | A1 | 2/2003 | Bhat et al. | |
| 2003/0117798 | A1 | 6/2003 | Leysath | |
| 2004/0042209 | A1 | 3/2004 | Wehner et al. | |
| 2004/0217362 | A1 | 11/2004 | Slater et al. | |
| 2005/0157503 | A1 | 7/2005 | Lin | |
| 2005/0211993 | A1 | 9/2005 | Sano et al. | |
| 2005/0242358 | A1 | 11/2005 | Chung-Cheng et al. | |
| 2006/0060874 | A1 | 3/2006 | Edmond et al. | 257/98 |
| 2006/0163586 | A1 | 7/2006 | Denbaars et al. | |
| 2006/0278885 | A1 | 12/2006 | Tain et al. | |
| 2007/0158668 | A1 | 7/2007 | Tarsa et al. | 257/79 |
| 2008/0123341 | A1 * | 5/2008 | Chiu | 362/294 |
| 2008/0173884 | A1 | 7/2008 | Chitnis et al. | 438/22 |
| 2008/0179611 | A1 | 7/2008 | Chitnis et al. | 257/98 |
| 2008/0185609 | A1 | 8/2008 | Kozawa et al. | |
| 2008/0310158 | A1 | 12/2008 | Harbers et al. | 362/294 |
| 2009/0050908 | A1 | 2/2009 | Yuan et al. | 257/88 |
| 2009/0103293 | A1 * | 4/2009 | Harbers et al. | 362/231 |
| 2009/0121241 | A1 | 5/2009 | Keller et al. | 257/94 |
| 2009/0152583 | A1 | 6/2009 | Chen et al. | 257/98 |
| 2009/0161356 | A1 * | 6/2009 | Negley et al. | 362/231 |
| 2009/0161367 | A1 * | 6/2009 | Vanden Eynden | 362/297 |
| 2009/0231856 | A1 | 9/2009 | Householder | |
| 2009/0283779 | A1 | 11/2009 | Negley et al. | 257/88 |
| 2009/0283787 | A1 | 11/2009 | Donofrio et al. | |
| 2009/0323334 | A1 * | 12/2009 | Roberts et al. | 362/247 |
| 2010/0039822 | A1 * | 2/2010 | Bailey | 362/296.1 |
| 2010/0051995 | A1 | 3/2010 | Katsuno et al. | |
| 2010/0059785 | A1 | 3/2010 | Lin et al. | |
| 2010/0065881 | A1 | 3/2010 | Kim | |
| 2010/0140636 | A1 | 6/2010 | Donofrio et al. | 257/98 |
| 2010/0165633 | A1 * | 7/2010 | Moolman et al. | 362/298 |
| 2011/0049546 | A1 | 3/2011 | Heikman et al. | 257/98 |

FOREIGN PATENT DOCUMENTS

| | | | |
|---|---|---|---|
| WO | WO2005078338 | A1 | 8/2005 |
| WO | WO2005117152 | | 12/2005 |
| WO | WO 2006/092697 | A1 | 9/2006 |
| WO | WO 2008/089324 | A2 | 7/2008 |
| WO | WO 2008/149265 | A1 | 12/2008 |
| WO | WO 2009/056927 | A1 | 5/2009 |

OTHER PUBLICATIONS

Windisch et al. "Impact of Texture-Enhanced Transmission on High-Efficiency Surface-Textured Light-Emitting Diodes," Applied Physics Letters, vol. 79, No. 15, Oct. 2001, pp. 2315-2317.

Schnitzer et al. "30% External Quantum Efficiency From Surface Textured, Thin-Film Light-Emitting Diodes," Applied Physics Letters, Oct. 18, 1993, vol. 64, No. 16, pp. 2174-2176.

Windisch et al. "Light-Extraction Mechanisms in High-Efficiency Surface-Textured Light-Emitting Diodes," IEEE Journal on Selected Topics in Quantum Electronics, vol. 8, No. 2, Mar./Apr. 2002, pp. 248-255.

Streubel, et al. "High Brightness AlGaInP Light-Emitting Diodes," IEEE Journal on Selected Topics in Quantum Electronics, vol. 8, No. 2, Mar./Apr. 2002, pp. 321-332.

US RE34,681, 8/1994, Davis et al. (withdrawn).

CREE EZ400 LED Data Sheet, 2007 Cree's EZBright LEDs.

CREE EZ700 LED Data Sheet, 2007 Cree's EZBright LEDs.

CREE EZ1000 LED Data Sheet, 2007 Cree's EZBright LEDs.

CREE EZBright290 LED Data Sheet, 2007 Cree's EZBright LEDs.

Related U.S. Appl. No. 12/154,691, filed May 23, 2008.

Related U.S. Appl. No. 12/156,995, filed Jun. 5, 2008.

Related U.S. Appl. No. 12/475,261, filed May 29, 2009.

International Search Report and Written Opinion for counterpart application PCT/US2010/000817 mailed Jul. 27, 2010.

U.S. Appl. No. 12/154,691, filed May 23, 2008 and U.S. Appl. No. 12/156,995, filed Jun. 5, 2008 assigned to CREE, Inc. "Solid State Lighting Component".

International Search Report and Written Opinion for PCT Application No. PCT/US2010/002827 mailed May 2, 2011.

Office Action from U.S. Appl. No. 12/329,722, Dated: Oct. 27, 2010.

International Preliminary Report on Patentability from Application No. PCT/US09/66938, dated Apr. 3, 2012.

"High-Performance GaN-Based Vertical-Injection Light-Emitting Diodes With TiO2-SiO2 Omnidirectional Reflector and n-GaN Roughness" by H. W. Huang, et al., IEEE Photonics Technology Letters, vol. 19, No. 8, Apr. 15, 2007, pp. 565-567.

DOM LED Downlighting, Lithonia Lighting: an Acuity Brands, Company, www.lithonia.com © 2009.

Ecos. Lighting the Next Generation, gothan: a division of Acuity Brands Lighting Inc., © 2008.

International Search Report and Written Opinion for Application No. PCT/US2012/034564, dated Sep. 5, 2012.

Office Action from U.S. Appl. No. 13/415,626, dated: Sep. 28, 2012.

Response to Office Action from U.S. Appl. No. 13/415,626, filed: Jan. 23, 2013.

Office Action from patent U.S. Appl. No. 12/855,500, dated: Oct. 1, 2012.

Response to Office Action from U.S. Appl. No. 12/855,500, filed: Feb. 25, 2013.

Office Action from U.S. Appl. No. 12/606,377, dated: Nov. 26, 2012.

Response to Office Action from U.S. Appl. No. 12/606,377, filed: Feb. 22, 2012.

Office Action from U.S. Appl. No. 12/757,179. dated: Dec. 31, 2012.

Office Action from U.S. Appl. No. 13/415,626, dated: Feb. 28, 2013.

Streubel et al., "Fabrication of InP/air-gap distributed Bragg reflectors and micro-cavities", 1997, Materials Science and Engineering, vol. B44. pp. 364-367, Feb. 1997.

U.S. Patent Application Publication No. US 2006/0157723, Lambkin, Jul. 2006.

U.S. Patent Application Publication No. US 2003/0128733, Tan et al., Jul. 2003.

U.S. Patent Application Publication No. US 2005/0168994, Jacobson et al., Aug. 2005.

U.S. Patent Application Publication No. US 2010/0039822, Bailey, Edward, Feb. 2010.

U.S. Patent Application Publication No. US 2010/0117099, Leung, Jacob Chi Wing, May 2010.

U.S. Patent Application Publication No. US 2010/0001299, Chang et al., Jan. 2010.

U.S. Patent Application Publication No. US 2008/0265268, Braune et al., Oct. 2008.

U.S. Patent Application Publication No. US 2010/0103678, Van De Ven at al., Apr. 2010.

U.S. Patent Application Publication No. US 2010/0165633, Moolman et al., Jul. 2010.

U.S. Patent Application Publication No. 2011/0075423, Van De Ven, Antony Paul, Mar. 2011.

Kobayashi et al., "Optical Investigation on the Growth Process of GaAs During Migration-Enhanced Epitaxy", Japanese Journal of Applied Physics, vol. 28, No. 11, pp. L 1880-L 1882, Nov., 1989.

* cited by examiner

FIG. 1
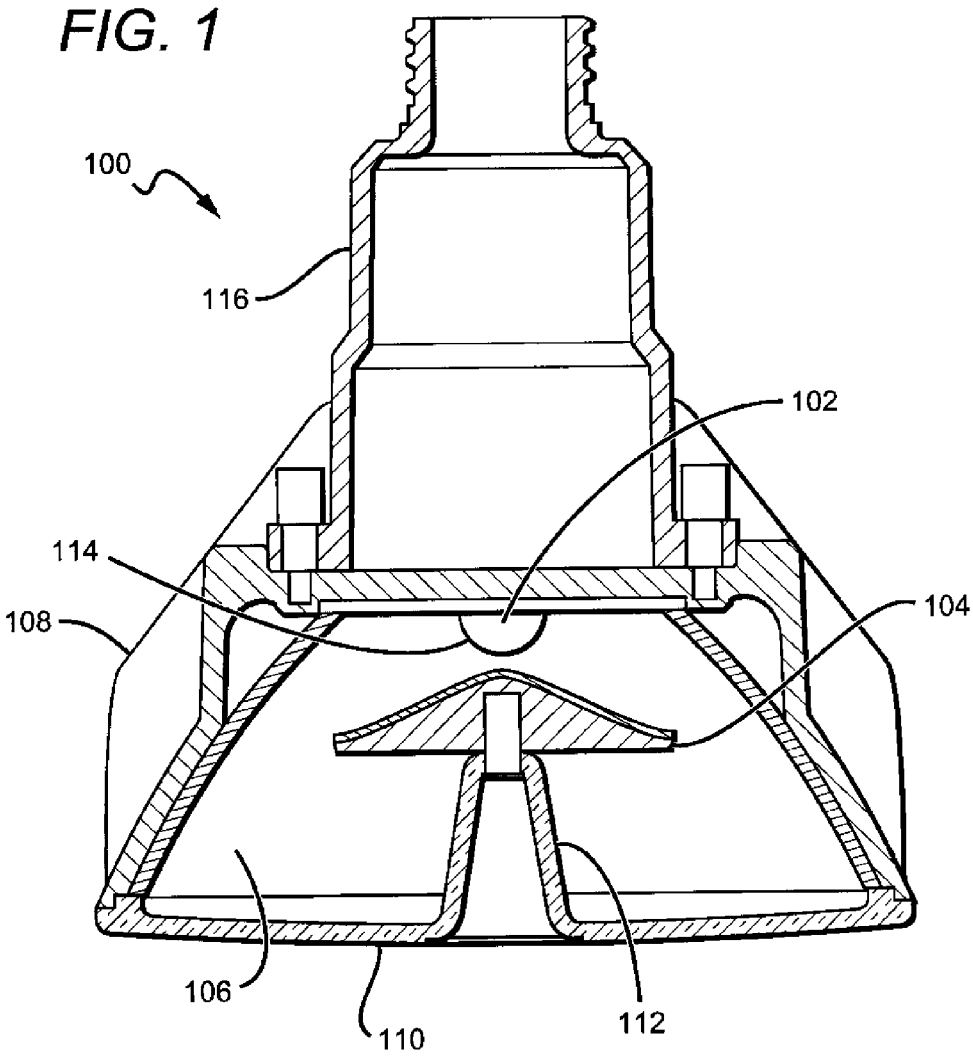
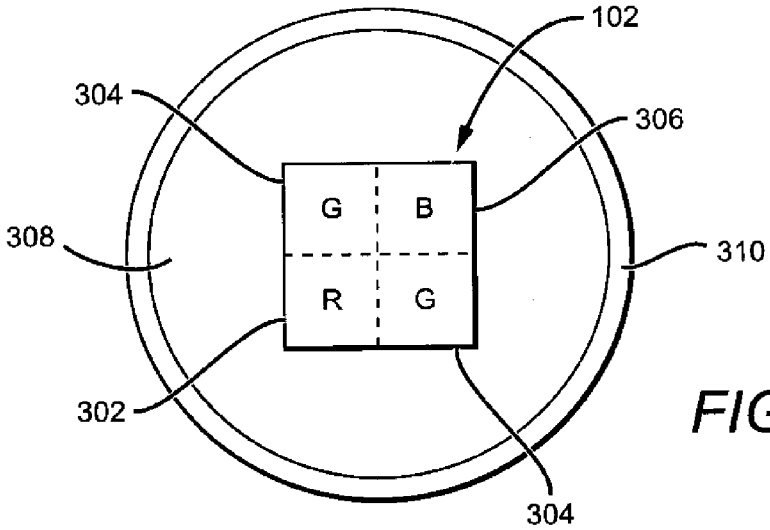
FIG. 3

FIG. 2
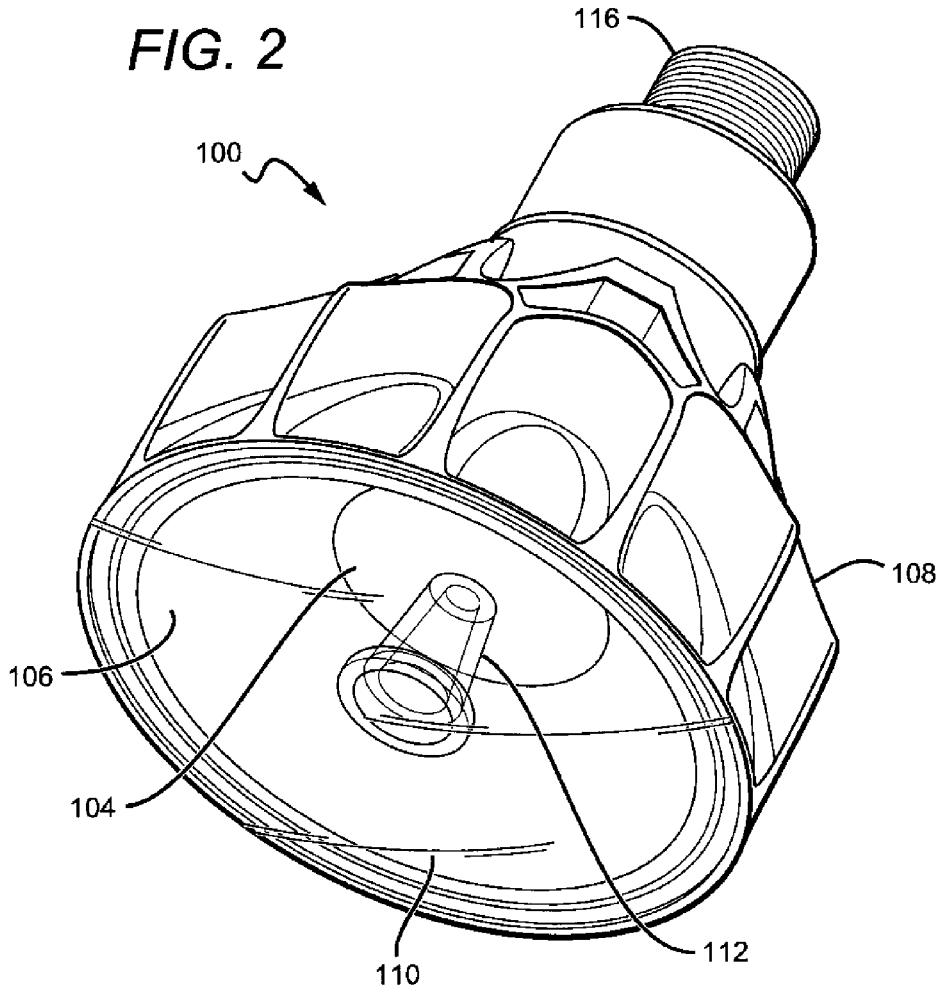
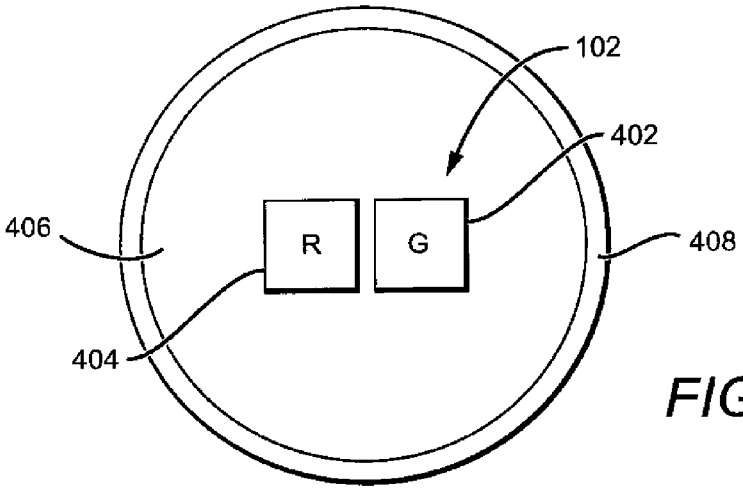
FIG. 4

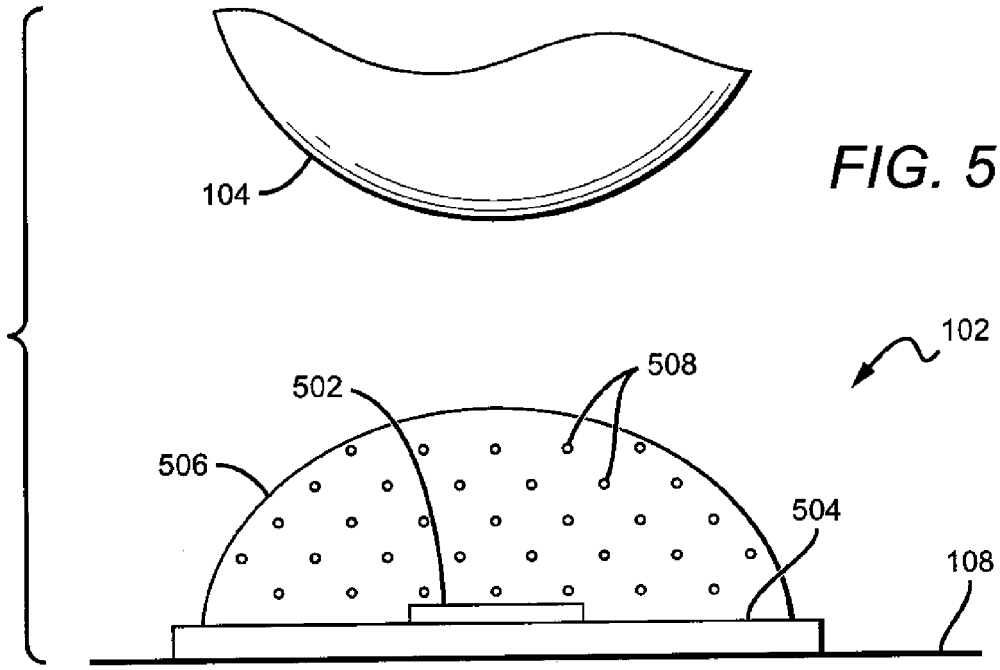
FIG. 5
FIG. 6
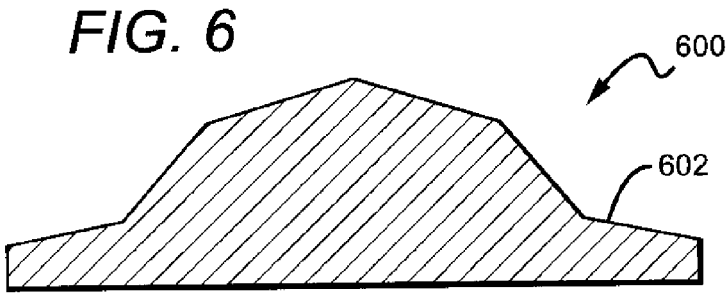
FIG. 7
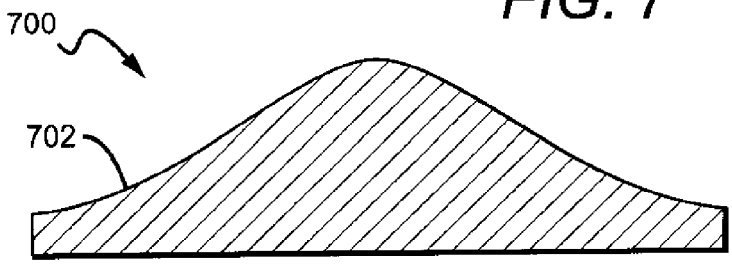

FIG. 11
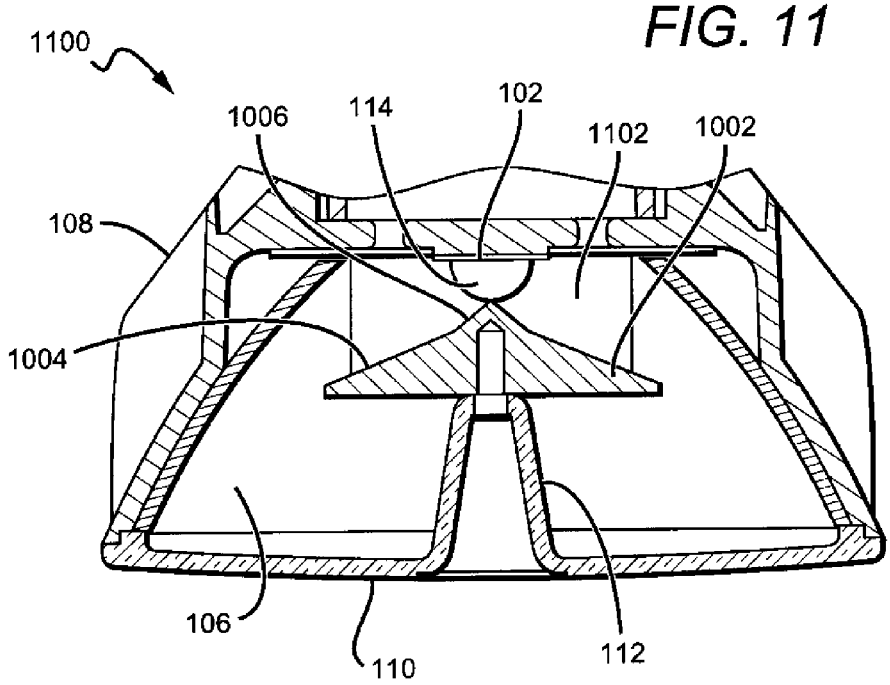
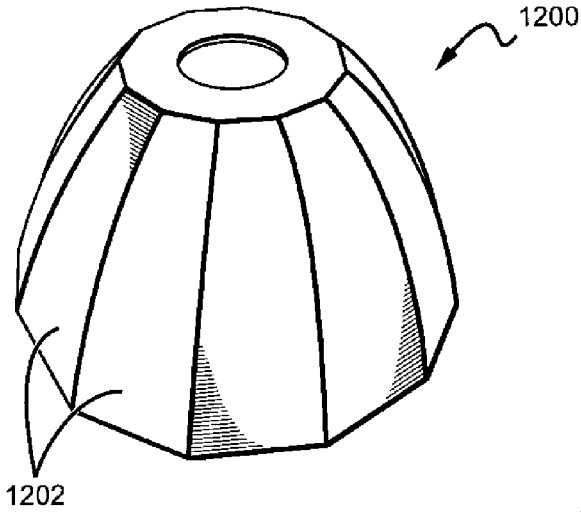
FIG. 12a
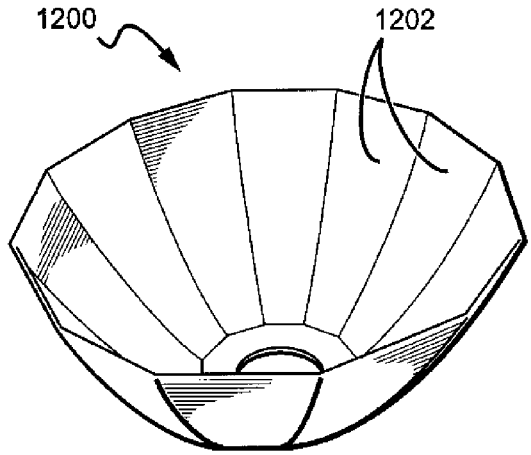
FIG. 12b

REFLECTOR SYSTEM FOR LIGHTING DEVICE

BACKGROUND OF THE INVENTION

1. Field of the Invention

The invention relates generally to reflector systems for lighting applications and, more particularly, to reflector systems for multi-element light sources.

2. Description of the Related Art

Light emitting diodes (LED or LEDs) are solid state devices that convert electric energy to light, and generally comprise one or more active regions of semiconductor material interposed between oppositely doped semiconductor layers. When a bias is applied across the doped layers, holes and electrons are injected into the active region where they recombine to generate light. Light is emitted from the active region and from surfaces of the LED.

In order to generate a desired output color, it is sometimes necessary to mix colors of light which are more easily produced using common semiconductor systems. Of particular interest is the generation of white light for use in everyday lighting applications. Conventional LEDs cannot generate white light from their active layers; it must be produced from a combination of other colors. For example, blue emitting LEDs have been used to generate white light by surrounding the blue LED with a yellow phosphor, polymer or dye, with a typical phosphor being cerium-doped yttrium aluminum garnet (Ce:YAG). The surrounding phosphor material "downconverts" some of the LED's blue light, changing its color to yellow. Some of the blue light passes through the phosphor without being changed while a substantial portion of the light is downconverted to yellow. The LED emits both blue and yellow light, which combine to provide a white light.

In another known approach light from a violet or ultraviolet emitting LED has been converted to white light by surrounding the LED with multicolor phosphors or dyes. Indeed, many other color combinations have been used to generate white light.

Because of the physical arrangement of the various source elements, multicolor sources often cast shadows with color separation and provide an output with poor color uniformity. For example, a source featuring blue and yellow sources may appear to have a blue tint when viewed head on and yellow tint when viewed from the side. Thus, one challenge associated with multicolor light sources is good spatial color mixing over the entire range of viewing angles.

One known approach to the problem of color mixing is to use a diffuser to scatter light from the various sources; however, a diffuser usually results in a wide beam angle. Diffusers may not be feasible where a narrow, more controllable directed beam is desired.

Another known method to improve color mixing is to reflect or bounce the light off of several surfaces before it is emitted. This has the effect of disassociating the emitted light from its initial emission angle. Uniformity typically improves with an increasing number of bounces, but each bounce has an associated loss. Many applications use intermediate diffusion mechanisms (e.g., formed diffusers and textured lenses) to mix the various colors of light. These devices are lossy and, thus, improve the color uniformity at the expense of the optical efficiency of the device.

Many modern lighting applications demand high power LEDs for increased brightness. High power LEDs can draw large currents, generating significant amounts of heat that must be managed. Many systems utilize heat sinks which must be in good thermal contact with the heat-generating light sources. Some applications rely on cooling techniques such as heat pipes which can be complicated and expensive.

SUMMARY OF THE INVENTION

One exemplary embodiment of a light emitting device according to the present invention comprises the following elements. A multi-element light source is mounted at the base of a secondary reflector. The secondary reflector is adapted to shape and direct an output light beam. A primary reflector is disposed proximate to the light source to redirect light from the source toward the secondary reflector. The primary reflector is shaped to reflect light from the multi-element source such that the light is spatially mixed prior to incidence on the secondary reflector.

One exemplary embodiment of a lamp device according to the present invention comprises the following elements. A protective housing surrounds a multi-element light source. The housing has an open end through which light may be emitted. A secondary reflector is disposed inside the housing and around the light source such that the light source is positioned at the center of the base of the secondary reflector. A primary reflector is disposed to reflect light emitted from the source toward the secondary reflector such that the light is spatially mixed prior to incidence on the secondary reflector. A lens plate is disposed over the open end of the housing.

BRIEF DESCRIPTION OF THE DRAWINGS

FIG. 1 is a cross-sectional view of a lamp device along its diameter according to one embodiment of the present invention.

FIG. 2 is a perspective view of a lamp device according to one embodiment of the present invention.

FIG. 3 is a top plan view of a light source according to one embodiment of the present invention.

FIG. 4 is a top plan view of a light source according to one embodiment of the present invention.

FIG. 5 is a cross-sectional view of a light source and the tip section of a primary reflector according to one embodiment of the present invention.

FIG. 6 is a cross-sectional view of a primary reflector according to one embodiment of the present invention.

FIG. 7 is a cross-sectional view of a primary reflector according to one embodiment of the present invention.

FIG. 11 is a cross-sectional view of a lamp device along its diameter according to one embodiment of the present invention.

FIG. 12*a* is a perspective view of a secondary reflector according to an embodiment of the present invention.

FIG. 12*b* is a perspective view of a secondary reflector according to an embodiment of the present invention.

DETAILED DESCRIPTION OF THE INVENTION

Figure 8:
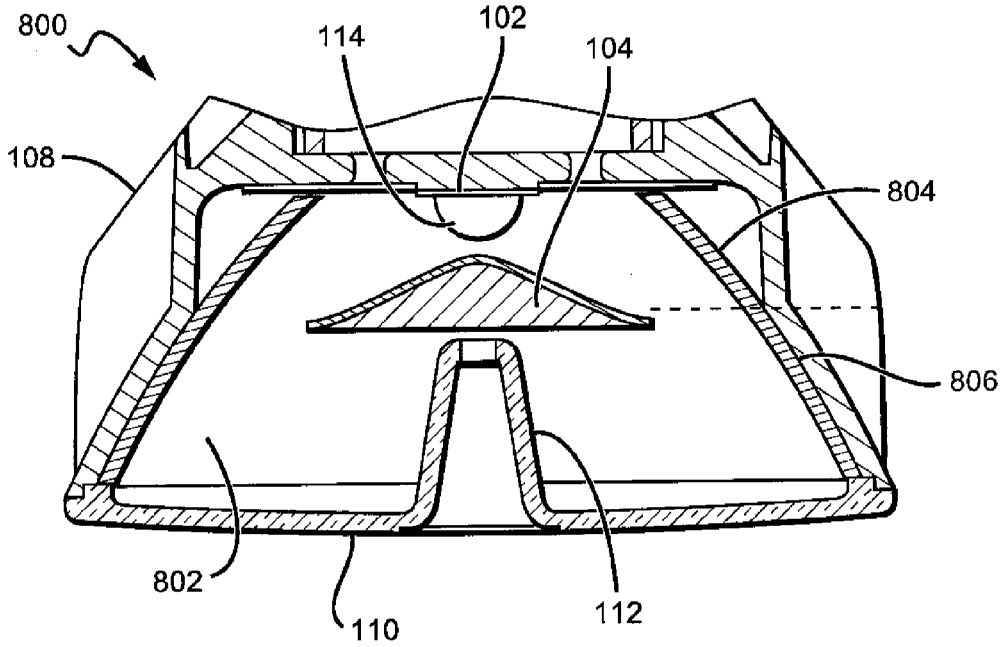
FIG. 8 is a cross-sectional view of a lamp device along its diameter according to one embodiment of the present invention.

Embodiments of the present invention provide a reflector system for lighting applications, especially multi-source solid state systems. The system works particularly well with multicolor light emitting diode (LED) arrangements to provide a tightly focused beam of white light with good spatial color uniformity. The sources can be chosen to produce varying shades of white light (e.g., warmer whites or cooler whites) or colors of light other than white. Applications range from commercial and industrial lighting to military, law enforcement and other specialized uses.

The system uses two reflective surfaces to redirect the light before it is emitted. This is sometimes referred to as a "double-bounce" configuration. The light source/sources are disposed at the base of the secondary reflector. The first reflective surface is provided by the primary reflector which is arranged proximate to the source/sources. The primary reflector initially redirects, and in some cases diffuses, light from the sources such that the different wavelengths of light are mixed as they are redirected toward the secondary reflector. The secondary reflector functions primarily to shape the light into a desired output beam. Thus, the primary reflector is used color mix the light, and the secondary reflector is used to shape the output beam. The reflector arrangement allows the source to be placed at the base of the secondary reflector where it may be thermally coupled to a housing or another structure to provide an outlet for heat generated by the sources.

It is understood that when an element is referred to as being "on" another element, it can be directly on the other element or intervening elements may also be present. Furthermore, relative terms such as "inner", "outer", "upper", "above", "lower", "beneath", and "below", and similar terms, may be used herein to describe a relationship of one element to another. It is understood that these terms are intended to encompass different orientations of the device in addition to the orientation depicted in the figures.

Although the ordinal terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present invention.

As used herein, the term "source" can be used to indicate a single light emitter or more than one light emitter functioning as a single source. For example, the term may be used to describe a single blue LED, or it may be used to describe a red LED and a green LED in proximity emitting as a single source. Thus, the term "source" should not be construed as a limitation indicating either a single-element or a multi-element configuration unless clearly stated otherwise.

The term "color" as used herein with reference to light is meant to describe light having a characteristic average wavelength; it is not meant to limit the light to a single wavelength. Thus, light of a particular color (e.g., green, red, blue, yellow, etc.) includes a range of wavelengths that are grouped around a particular average wavelength.

FIG. 1 and FIG. 2 illustrate a lamp device 100 comprising a reflector system according to one embodiment of the present invention.

FIG. 1 is a cross-sectional view of the lamp device 100 along its diameter. A light source 102 is disposed at the base of a bowl-shaped region within the lamp 100. Many applications, for example white light applications, necessitate a multicolor source to generate a blend of light that appears as a certain color. Because light within one wavelength range will trace out a different path than light within another wavelength range as they interact with the materials of the lamp, it is necessary to mix the light sufficiently so that color patterns are not noticeable in the output, giving the appearance of a homogenous source.

A primary reflector 104 is disposed proximate to the light source 102. The light emitted from the source 102 interacts with the primary reflector 104 such that the color is mixed as it is redirected toward a secondary reflector 106. The secondary reflector 106 receives the mixed light and shapes it into a beam having characteristics that are desirable for a given application. A protective housing 108 surrounds the light source 102 and the reflectors 104, 106. The source 102 is in good thermal contact with the housing 108 at the base of the secondary reflector 106 to provide a pathway for heat to escape into the ambient. A lens plate 110 covers the open end of the housing 108 and provides protection from outside elements. Protruding inward from the lens plate 110 is a mount post 112 that holds the primary reflector 104 in place, proximate to the light source 102.

The light source 102 may comprise one or more emitters producing the same color of light or different colors of light. In one embodiment, a multicolor source is used to produce white light. Several colored light combinations will yield white light. For example, it is known in the art to combine light from a blue LED with wavelength-converted yellow light to create a white output. Both blue and yellow light can be generated with a blue emitter by surrounding the emitter with phosphors that are optically responsive to the blue light. When excited, the phosphors emit yellow light which then combines with the blue light to make white. In this scheme, because the blue light is emitted in a narrow spectral range it is called saturated light. The yellow light is emitted in a much broader spectral range and, thus, is called unsaturated light. Another example of generating white light with a multicolor source is combining the light from green and red LEDs. RGB schemes may be used to generate various colors of light. Sometimes an amber emitter is added for a RGBA combination. The previous combinations are exemplary; it is understood that many different color combinations may be used in embodiments of the previous invention. Several of these possible color combinations are discussed in detail in U.S. Pat. No. 7,213,940 to Van de Ven et al. which is commonly assigned with the present application to CREE LED LIGHTING SOLUTIONS, INC. and fully incorporated by reference herein.

Color combination can be achieved with a singular device having multiple chips or with multiple discreet devices arranged in proximity to each other. For example, the source 102 may comprise a multicolor monolithic structure (chip-on-board) bonded to a printed circuit board (PCB). In some embodiments, several LEDs are mounted to a submount to create a single compact optical source. Examples of such structures can be found in U.S. patent application Ser. Nos. 12/154,691 and 12/156,995, both of which are commonly assigned to CREE, INC., and both of which are fully incorporated by reference herein. In the embodiment shown in FIG. 1, the source 102 is protected by an encapsulant 114. Encapsulants are known in the art and, therefore, only briefly discussed herein. The encapsulant 114 material may contain wavelength conversion materials, such as phosphors for example.

The encapsulant 114 may also contain light scattering particles to help with the color mixing process in the near field. Although light scattering particles dispersed within the encapsulant 114 may cause optical losses, it may be desirable in some applications to use them in concert with the reflectors 104, 106 so long as the optical efficiency is acceptable.

Color mixing in the near field may be aided by providing a scattering/diffuser material or structure in close proximity to the light sources. The diffuser is in, on, or remote from, but in close proximity to, the LED chips with the diffuser arranged so that the lighting/LED component can have a low profile while still mixing the light from the LED chips in the near field. By diffusing in the near field, the light may be pre-mixed to a degree prior to interacting with either reflector.

A diffuser can comprise many different materials arranged in many different ways. In some embodiments, a diffuser film can be provided on the encapsulant 114. In other embodiments, the diffuser can be included within the encapsulant 114. In still other embodiments, the diffuser can be remote from the encapsulant, but not so remote as to provide substantial mixing from the reflection of light external to the lens. Many different structures and materials can be used as a diffuser such as scattering particles, geometric scattering structures or microstructures, diffuser films comprising microstructures, or diffuser films comprising index photonic films. The diffuser can take many different shapes over the LED chips; it can be flat, hemispheric, conic, and variations of those shapes, for example.

The encapsulant 114 may also function as a lens to shape the beam prior to incidence on the primary reflector 104.

Light emitted from the source is first incident on the primary reflector 104. The primary reflector 104 is disposed proximate to the source 102 so that substantially all of the emitted light interacts with it. In one embodiment the mount post 112 supports the primary reflector 104 in position near the source 102. A screw, an adhesive, or any other means of attachment may be used to secure the primary reflector 104 to the mount post 112. Because the mounting post 112 is hidden behind the primary reflector 104 relative to the source 102, the mounting post 112 blocks very little light as it exits through the lens plate 110.

The primary reflector 104 may comprise a specular reflective material or a diffuse material. If a specular material is used, the primary reflector 104 may be faceted to prevent the source from imaging in the output. One acceptable material for a specular reflector is a polymeric material that has been vacuum metallized with a metal such as aluminum or silver. Another acceptable material would be optical grade aluminum that is shaped using a known process, such as stamping or spinning. The primary reflector 104 may be shaped from a material that is itself reflective, or it may be shaped and then covered or coated with a thin film of reflective material. If a specular material is used, the primary reflector 104 will preferably have a reflectivity of no less than 88% in the relevant wavelength ranges.

The primary reflector 104 may also comprise a highly reflective diffuse white material, such as a microcellular polyethylene terephthalate (MCPET). In such an embodiment, the primary reflector 104 functions as a reflector and a diffuser.

The primary reflector 104 can be shaped in many different ways to reflect the light from the source 102 toward the secondary reflector 106. In the embodiment shown in FIG. 1, the primary reflector 104 has a generally conic shape that tapers down to the edges. The shape of the primary reflector 104 should be such that substantially all of the light emitted from the source 102 interacts with the primary reflector 104 prior to interacting with the secondary reflector 106.

The primary reflector 104 mixes the light and redirects it toward the secondary reflector 106. The secondary reflector 106 may be specular or diffuse. Many acceptable materials may be used to construct the secondary reflector 106. For example, a polymeric material which has been flashed with a metal may used. The secondary reflector 106 can also be made from a metal, such as aluminum or silver.

The secondary reflector 106 principally functions as a beam shaping device. Thus, the desired beam shape will influence the shape of the secondary reflector 106. The secondary reflector 106 is disposed such that it may be easily removed and replaced with other secondary reflectors to produce an output beam having particular characteristics. In the embodiment shown in FIG. 1, the secondary reflector 106 has a substantially parabolic cross section with a truncated end portion that allows for a flat surface on which to mount the source 102. Light redirected from the primary reflector 104 is incident on the surface of the secondary reflector 106. Because the light has already been at least partially color-mixed by the primary reflector 104, the designer has added flexibility in designing the secondary reflector 106 to form a beam having the desired characteristics. Thus, the reflector configuration provides a tailored output beam without sacrificing spatial color uniformity. The lamp device 100 features a bowl-shaped secondary reflector 106; however, other structure shapes are possible, a few examples of which are discussed below with reference to FIGS. 12*a* and 12*b*.

The secondary reflector 106 may be held inside the housing 108 using known mounting techniques, such as screws, flanges, or adhesives. In the embodiment of FIG. 1, the secondary reflector 106 is held in place by the lens plate 110 which is affixed to the open end of the housing 108. The lens plate 110 may be removed, allowing easy access to the secondary reflector 106 should it need to be removed for cleaning or replacement, for example. The lens plate 110 may be designed to further tailor the output beam. For example, a convex shape may be used to tighten the output beam angle. The lens plate 110 may have many different shapes to achieve a desired optical effect.

The protective housing 108 surrounds the reflectors 104, 106 and the source 102 to shield these internal components from the elements. The lens plate 110 and the housing 108 may form a watertight seal to keep moisture from entering into the internal areas of the device 100. A portion of the housing 108 may comprise a material that is a good thermal conductor, such as aluminum or copper. The thermally conductive portion of the housing 108 can function as a heat sink by providing a path for heat from the source 102 through the housing 108 into the ambient. The source 102 is disposed at the base of the secondary reflector 106 such that the housing 108 can form good thermal contact with the source 102. Thus, the source 102 may comprise high power LEDs that generate large amounts of heat.

Power is delivered to the source 102 through a protective conduit 116. The lamp device 100 may be powered by a remote source connected with wires running through the conduit 116, or it may be powered internally with a battery that is housed within the conduit 116. The conduit 116 may be threaded as shown in FIG. 1 for mounting to an external structure. In one embodiment, an Edison screw shell may be attached to the threaded end to enable the lamp 100 to be used in a standard Edison socket. Other embodiments can include custom connectors such as a GU24 style connector, for example, to bring AC power into the lamp 100. The device may also be mounted to an external structure in other ways. The conduit 116 functions not only as a structural element, but may also provide electrical isolation for the high voltage circuitry that it houses which helps to prevent shock during installation, adjustment and replacement. The conduit 116 may comprise an insulative and flame retardant thermoplastic or ceramic, although other materials may be used.

FIG. 2 is a perspective view of the lamp device 100. The underside of the primary reflector 102 is visible through the transparent/translucent lens plate 110. The mounting post 112 extends up from the lens plate 110 and holds the primary reflector 104 proximate to the source 102 (obscured in FIG. 2). The lens plate 110 may be held in place with a flange or a groove as shown. Other attachment means may also be used. The inner surface of secondary reflector 106 is shown. In this embodiment, the secondary reflector 106 comprises a faceted surface; although in other embodiments the surface may be smooth. The faceted surface helps to further break up the image of the different colors from the source 102.

FIG. 3 is a top plan view of the source 102 according to one embodiment of the present invention. As discussed above, many different light source combinations may be used. In this particular embodiment, the source 102 comprises a singular device having four colored chips, namely a red emitter, two green emitters and a blue emitter. This arrangement is typical in RGB color schemes. All of the emitters 302, 304, 306 are disposed underneath an encapsulant 308. In this embodiment the encapsulant 308 is hemispherical. The encapsulant 308 may be shaped differently to achieve a desired optical effect. Light scattering particles or wavelength conversion particles may be dispersed throughout the encapsulant. The source 102 and the encapsulant 308 are arranged on a surface 310. The surface 310 may be a substrate, a PCB or another type of surface. The backside of the source 102 is in good thermal contact with the housing 108 (not shown in FIG. 3).

The physical arrangement of the emitters 302, 304, 306 on the surface 310 will cause some non-uniform color distribution (i.e., imaging) in the output if the colors are not mixed prior to escaping the lamp device 100. The double bounce from the primary reflector 102 to the secondary reflector 106 mixes the colors and prevents imaging of the LED arrangement in the output. The color of the output light is controlled by the emission levels of the individual emitters 302, 304, 306. A controller circuit may be employed to select the emission color by regulating the current to each of the emitters 302, 304, 306.

FIG. 4 is a top plan view of the source 102 according to an embodiment of the present invention. In the embodiment shown, two discrete emitters are used. A green emitter 402 and a red emitter 404 are disposed underneath an encapsulant 406 on a surface 408. In combination green and red light can produce white light. In other embodiments, blue LEDs and red LEDs may be combined to output white light. A portion of the light from the blue LEDs is downconverted to yellow ("blue-shifted yellow) and combined with the red light to yield white. Uniform color in the output is important in white light applications where color imaging is noticeable to the human eye. The discreet emitters 402, 404 may be manufactured separately and then mounted on the surface 408. The electrical connection is provided with traces to the bottom side of the emitters 402, 404.

FIG. 5 is a cross-sectional view of the source 102 according to one embodiment of the present invention. An emitter 502 is arranged on a surface 504. The emitter 502 comprises a singular blue LED. An encapsulant 506 surrounds the emitter 502. In this embodiment, wavelength conversion particles 508 are dispersed throughout the encapsulant 506. The wavelength conversion material may also be disposed in a conformal layer over the emitter 502. In other embodiments, the phosphor can be disposed remotely relative to the emitter 502. For example, the remote phosphor may be concentrated in a particular area of an encapsulant, or it may be included in a conformal layer that is not adjacent to the emitter 502. The emitter 502 emits blue light, a portion of which is then yellow-shifted by the wavelength conversion particles 508. This conversion process is known in the art. The unconverted blue light and the converted yellow light combine to produce a white light output. After the light leaves the encapsulant 508 it is incident on the primary reflector 104 (only the tip of the reflector 104 is shown in FIG. 5). The remote phosphor configuration can be used with many different color combinations as discussed above. For example, one or more blue LEDs may be used to a combination of blue and blue-shifted yellow, or one or more blue LEDs may combined with red LEDs to emit blue, blue-shifted yellow, and red. These colors may combine to emit white light.

FIG. 6 is a cross-sectional view of a primary reflector 600 according to one embodiment of the present invention. This particular reflector 600 has a faceted surface 602. The facets on the surface 602 break up the image of the multicolor source 102. The facets shown in FIG. 6 are relatively large so that they can easily be observed in the figure; however, the facets can be any size with miniature facets producing a more dramatic scattering effect.

FIG. 7 is a cross-sectional view of a primary reflector 700 according to one embodiment of the present invention. Unlike the primary reflector 600 shown in FIG. 6, the primary reflector 700 has a smooth surface 702. The contour of the surface 702 is designed to redirect substantially all of the light emitted from the source 102 toward the secondary reflector (not shown in FIG. 7) The primary reflector 700 has a generally conic shape with the tapered edge regions. Many different surface contours are possible.

FIG. 8 shows a cross-sectional view of a lamp device 800 along a diameter. The device 800 includes similar elements as the lamp device 100 of FIG. 1. This particular embodiment features a secondary reflector 802 that is defined by two different parabolic sections. A first parabolic section 804 is disposed closer to the base of the secondary reflector 802. The second parabolic section 806 defines the outer portion of the secondary reflector 802 that is closer to the housing opening through which light is emitted. These parabolic sections 804, 806 are shaped to achieve an output beam with particular characteristics and may be defined by curves having various shapes. Although secondary reflector 802 is shown having two curved segments, it is understood that other embodiments may include more than two curved segments.

Figure 9A:
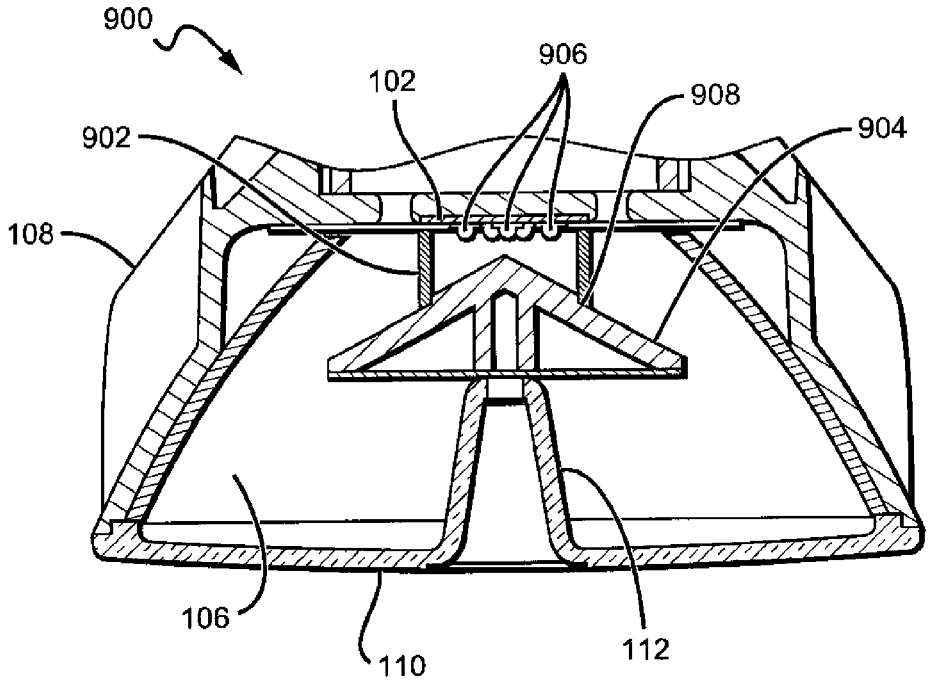
FIG. 9*a* is a cross-sectional view of a lamp device along its diameter according to one embodiment of the present invention.
Figure 9B:
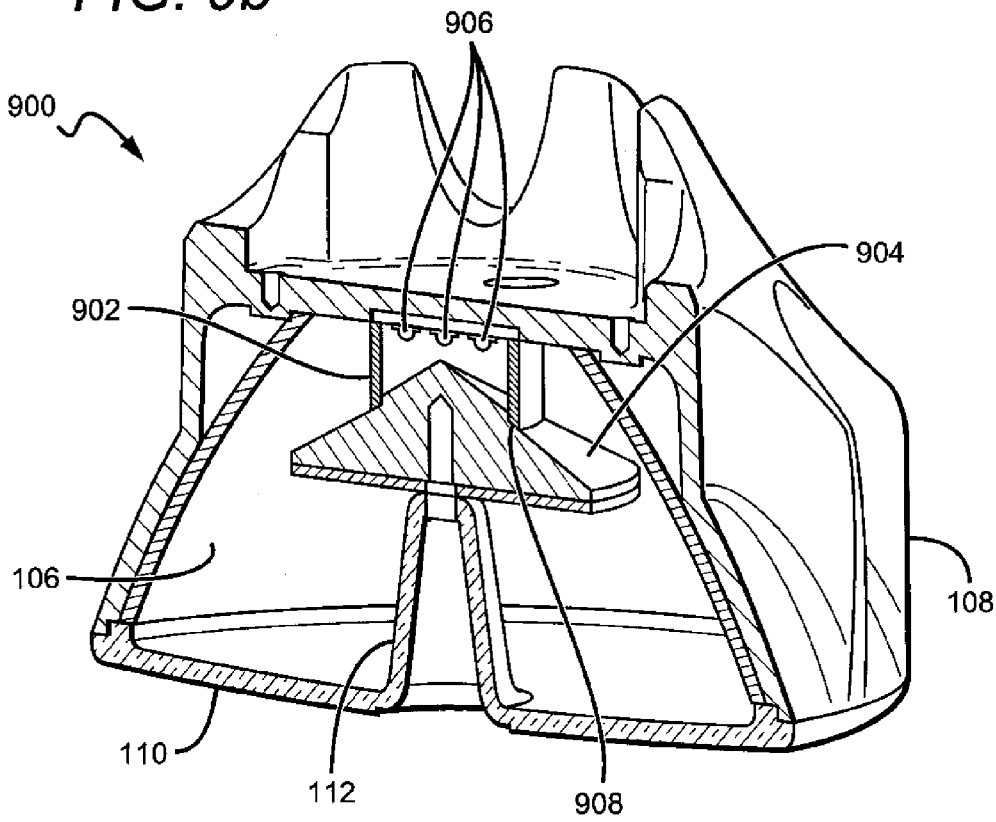
FIG. 9*b* is a perspective view with an exposed cross-section of a lamp device according to one embodiment of the present invention.

FIGS. 9*a* and 9*b* show two views of a lamp device 900. FIG. 9*a* shows a cross-sectional view of the lamp device 900 along a diameter. FIG. 9*b* shows a perspective view of the lamp device 900 with the cross-section cutaway shown. The device 900 includes similar elements as the lamp device 100 of FIG. 1. This particular embodiment includes a tube element 902 that surrounds the light source 102 and extends from the base of the secondary reflector 106 to the primary reflector 904. The light source 102 in this embodiment comprises multiple discreet LEDs 906 that are mounted to the base of the secondary reflector 106. Each of these LEDs 906 has its own encapsulant. As discussed above, these LEDs may be different colors which are combined using the double-bounce structure to yield a desired output color.

The tube element 902 may be cylindrical as shown in FIG. 9 or it may be another shape, for example, elliptical. The tube element comprises an aggressive diffuser. The diffusive material may be dispersed throughout the volume of the tube, or it may be coated on the inside or outside surface. As light is emitted from the LEDs 908, the tube element 902 guides the light toward the primary reflector 904 while, at the same, time mixing the colors. The added optical guidance helps to prevent light from spilling out around the edges of the primary reflector 904. The tube element 902 may also include a wavelength conversion material such as a phosphor. Phosphor particles may be dispersed throughout the volume of the tube element 902, or they may be coated on the inside or outside surface. In this way the tube element 902 may function to convert the wavelength of a portion of the emitted light. The tube element may be made from many materials including, for example, silicone, glass, or a transparent polymeric material such as poly(methyl methacrylate) (PMMA) or polycarbonate.

In this embodiment, the primary reflector has a notch 908 around the perimeter of the substantially conic structure. The tube element 902 cooperates with the notch 908 such that the inside surface of the tube element 902 abuts the circumferential outer surface of the notch 908. The tube element 902 may have an inner diameter such that it fits snugly over the notch 908, aligning and stabilizing the adjoined elements. The notch 908 functions not only as an alignment mechanism, it also reduces the amount of light that bleeds out between tube element 908 and the primary reflector 904 by effectively shielding the joint from the emitted light.

Figure 10:
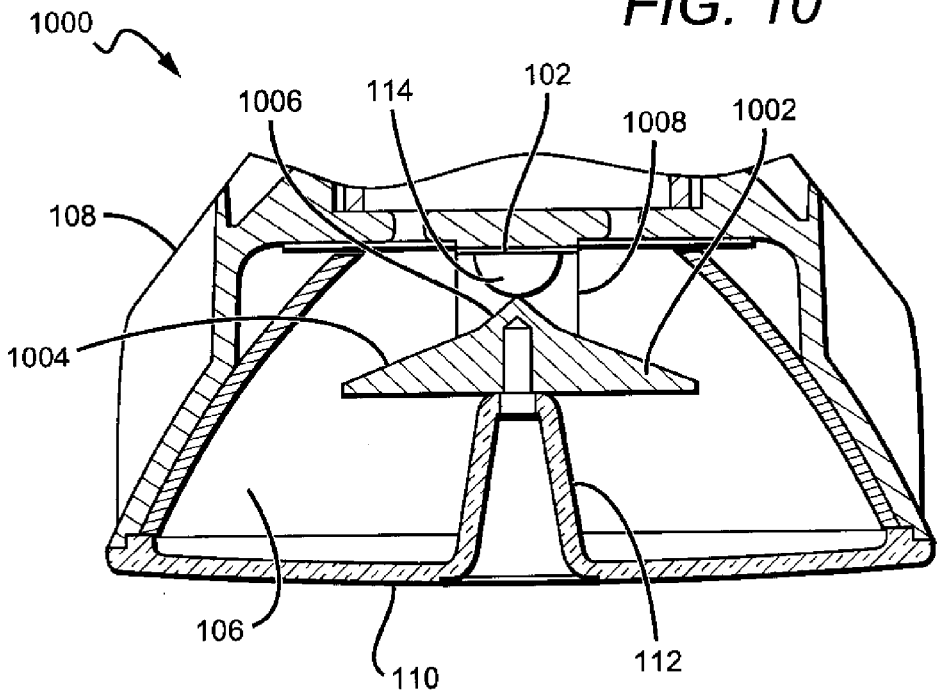
FIG. 10 is a cross-sectional view of a lamp device along its diameter according to one embodiment of the present invention.

FIG. 10 shows a cross-sectional view an embodiment of a lamp device 1000 along its diameter. In this particular embodiment the primary reflector 1002 has a cross-section defined by two linear segments. The first segment 1004 has a slope that is closer to normal with respect to an axis running longitudinally through the center of the device. The second segment 1006 has a more aggressive slope as shown. The tube element 1008 has an outer diameter that is just large enough to surround the encapsulant 114 and the first segment 1004 of the primary reflector 1002. Although not shown in FIG. 10, it is understood that a notch feature similar to the one shown in lamp device 900 may be included in any of the various primary reflector designs.

FIG. 11 shows a cross-sectional view of an embodiment of a lamp device 1100. Lamp device 1100 is similar to lamp device 1000 of FIG. 10 and contains several common elements. In this particular embodiment, the tube element 1102 has a large diameter which almost spans the entire width of the primary reflector 1002. Increasing the distance from the light source 102 and the tube element 1102 improves the color mixing and provides a more even distribution. Although the large diameter works well for these reasons, other diameters may be used to achieve a particular output profile.

FIGS. 12*a* and 12*b* show two perspective views of an embodiment of a secondary reflector 1200. Unlike the smooth bowl-shape of the secondary reflector 106 shown in FIG. 1, the secondary reflector 1200 features a segmented structure with a plurality of adjoined panels 1202. The panels 1202 may be smooth or faceted. They may formed of a material that is itself reflective or coated or covered with a reflective material.

Although the present invention has been described in detail with reference to certain preferred configurations thereof, other versions are possible. For example, embodiments of the lamp device may include various combinations of primary and secondary reflectors discussed herein. Therefore, the spirit and scope of the invention should not be limited to the versions described above.

We claim:

1. A light emitting device, comprising:

a multi-element light source;

a secondary reflector adapted to shape and direct an output light beam; and a primary reflector having a reflective surface that is disposed proximate to said light source such that substantially all of the light emitted by said light source interacts with said primary reflector and is redirected by said primary reflector from said source toward said secondary reflector, said primary reflector shaped to reflect light from said multi-element source such that the light is spatially mixed prior to incidence on said secondary reflector, said primary reflector positioned entirely within said secondary reflector.

2. The light emitting device of claim 1, further comprising a protective housing that partially surrounds said light source and said primary and secondary reflectors.

3. The light emitting device of claim 2, said protective housing comprising a thermally conductive material, said housing in thermal contact with said light source.

4. The light emitting device of claim 1, further comprising a tube element that surrounds said light source, said tube element extending away from the base of said secondary reflector to said primary reflector.

5. The light emitting device of claim 4, said primary reflector comprising a notch, said tube element cooperating with said notch such that the inner surface of said tube element abuts said notch.

6. The light emitting device of claim 4, said tube element comprising a wavelength conversion material.

7. The light emitting device of claim 1, said light source comprising a singular device having a plurality of light emitting diode (LED) chips, said plurality of LED chips selected to emit at least two different colors of light.

8. The light emitting device of claim 1, said light source comprising a plurality of discreet devices selected to emit at least two different colors of light.

9. The light emitting device of claim 1, wherein said light source emits a combination of colors that yields a white light output.

10. The light emitting device of claim 1, wherein said light source emits red and green light in a combination that yields white light.

11. The light emitting device of claim 1, wherein said light source emits blue and yellow light in a combination that yields white light.

12. The light emitting device of claim 1, said light source comprising a wavelength conversion material.

13. The light emitting device of claim 1, said primary reflector comprising a specular reflector.

14. The light emitting device of claim 13, said primary reflector further comprising a faceted surface.

15. The light emitting device of claim 13, said primary reflector further comprising a polymeric material with a metal coating.

16. The light emitting device of claim 1, said primary reflector comprising a highly reflective specular film on the surface of said primary reflector.

17. The light emitting device of claim 1, said primary reflector comprising a diffuse reflector.

18. The light emitting device of claim 1, said primary reflector comprising a highly reflective diffuse white material.

19. The light emitting device of claim 1, said primary reflector comprising a micro-cellular polyethylene terephthalate (PET) material.

20. The light emitting device of claim 1, said primary reflector having a generally conic surface, said primary reflector disposed with the tip of said conic surface toward said light source.

21. The light emitting device of claim 1, said primary reflector defined by a diametric cross-section that is piecewise linear.

22. The light emitting device of claim 1, said secondary reflector having a generally parabolic shape.

23. The light emitting device of claim 1, said secondary reflector having a shape defined by a first parabolic section closer to the base of said secondary reflector and a second parabolic section farther from the base of said secondary reflector.

24. The light emitting device of claim 1, said secondary reflector comprising a polymeric material coated with a metal.

25. The light emitting device of claim 1, said secondary reflector comprising a metal.

26. The light emitting device of claim 1, said secondary reflector comprising a specular reflector.

27. The light emitting device of claim 1, said secondary reflector comprising a highly reflective specular film on the interior surface of said secondary reflector.

28. The light emitting device of claim 1, said secondary reflector comprising a plurality of adjoined curved panels.

29. A lamp device, comprising:

a multi-element light source;

a protective housing that surrounds said light source, said housing having an open end through which light may be emitted;

a secondary reflector disposed inside said housing and around said light source such that said light source is positioned at the approximate center of the base of said secondary reflector;

a primary reflector disposed to reflect light emitted from said source toward said secondary reflector such that said light is spatially mixed prior to incidence on said secondary reflector; and a lens plate disposed over said open end of said housing;

said primary reflector having a reflective surface that is disposed proximate to said light source and entirely within said secondary reflector such that substantially all of the light emitted by said multi-element light source interacts with said primary reflector and is redirected by said primary reflector from said light source toward said secondary reflector.

30. A lamp device, comprising:

a multi-element light source;

a protective housing that surrounds said light source, said housing having an open end through which light may be emitted;

a secondary reflector disposed inside said housing and around said light source such that said light source is positioned at the center of the base of said secondary reflector;

a primary reflector disposed to reflect light emitted from said source toward said secondary reflector such that said light is spatially mixed prior to incidence on said secondary reflector; and a lens plate disposed over said open end of said housing; and a mount post extending from said lens plate inward toward said light source, said primary reflector disposed on the end of said mount post proximate to said light source.

31. The lamp device of claim 29, wherein said housing comprises a thermally conductive material, said housing in thermal contact with said light source.

32. The lamp device of claim 29, said light source comprising a singular device having a plurality of light emitting diode (LED) chips disposed on said device, said plurality of LED chips selected to emit at least two different colors of light.

33. The lamp device of claim 29, said light source comprising a plurality of discreet devices selected to emit at least two different colors of light.

34. The lamp device of claim 29, wherein said light source emits a combination of light colors that yields a white light output.

35. The lamp device of claim 29, wherein said light source emits red and green light in a combination that yields white light.

36. The lamp device of claim 29, wherein said light source emits blue and yellow light in a combination that yields white light.

37. The lamp device of claim 29, said light source comprising a wavelength conversion material.

38. The lamp device of claim 29, said primary reflector comprising a specular reflector.

39. The lamp device of claim 38, said primary reflector further comprising a faceted surface.

40. The lamp device of claim 38, said primary reflector further comprising a polymeric material with a metal coating.

41. The lamp device of claim 29, said primary reflector comprising a diffuse reflector.

42. The lamp device of claim 29, said primary reflector comprising a highly reflective diffuse white material.

43. The lamp device of claim 29, said primary reflector comprising a micro-cellular polyethylene terephthalate (PET) material.

44. The lamp device of claim 29, said primary reflector having a generally conic surface, said primary reflector disposed with the tip of said conic surface toward said light source.

45. The lamp device of claim 29, said secondary reflector having a generally parabolic shape.

46. The lamp device of claim 29, said secondary reflector comprising a polymeric material coated with a metal.

47. The lamp device of claim 29, said secondary reflector comprising a metal.

48. The lamp device of claim 29, said secondary reflector comprising a specular reflector.

49. The lamp device of claim 29, further comprising a protective conduit shaped to house wires for providing power to said light source.

50. The lamp device of claim 49, said protective conduit adapted to mount to a surface.

51. The lamp device of claim 49, said protective conduit comprising a material that is insulative and flame retardant.

52. The lamp device of claim 29, wherein said secondary reflector is removable from said housing without removing said light source.

53. The lamp device of claim 29, further comprising a tube element that surrounds said light source and extends away from the base of said secondary reflector to said primary reflector.

54. The lamp device of claim 53, said primary reflector comprising a notch, said tube element cooperating with said notch such that the inside surface of said tube abuts against said notch.

55. The lamp device of claim 53, said tube element comprising a wavelength conversion material.

56. The lamp device of claim 29, said primary reflector comprising a highly reflective film on the surface of said primary reflector.

57. The lamp device of claim 29, said secondary reflector comprising a highly reflective film on the interior surface of said secondary reflector.

58. The light emitting device of claim 1, wherein said multi-element light source is mounted at the base of said secondary reflector.

59. The light emitting device of claim 1, wherein said multi-element light source is mounted below said primary reflector such that substantially all of the light emitted by said light source interacts with the reflective surface of said primary reflector.

60. The light emitting device of claim 1, wherein the primary reflector is disposed to mix color of the light from the light source.

61. The lamp device of claim 29, wherein the primary reflector is disposed to mix color of the light from the light source.

62. The lamp device of claim 30, wherein the primary reflector is disposed to mix color of the light from the light source.

* * * * *